US010317140B2

(12) United States Patent
Popov

(10) Patent No.: US 10,317,140 B2
(45) Date of Patent: Jun. 11, 2019

(54) MELTING PLANT AND METHOD

(71) Applicant: ALD VACUUM TECHNOLOGIES GMBH, Hanau (DE)

(72) Inventor: Ivaylo Popov, Hanau (DE)

(73) Assignee: ALD Vacuum Technologies GmbH, Hanau (DE)

( * ) Notice: Subject to any disclaimer, the term of this patent is extended or adjusted under 35 U.S.C. 154(b) by 0 days.

(21) Appl. No.: 15/843,522

(22) Filed: Dec. 15, 2017

(65) Prior Publication Data

US 2018/0172353 A1 Jun. 21, 2018

(30) Foreign Application Priority Data

Dec. 15, 2016 (DE) ..... 10 2016 124 481

(51) Int. Cl.

| | |
|---|---|
| ***H05B 7/00*** | (2006.01) |
| ***C22B 9/18*** | (2006.01) |
| ***F27D 7/06*** | (2006.01) |
| ***F27D 3/00*** | (2006.01) |
| ***F27D 3/08*** | (2006.01) |
| ***F27D 3/14*** | (2006.01) |

(52) U.S. Cl.

CPC ..... *F27D 7/06* (2013.01); *F27D 3/0024* (2013.01); *F27D 3/0027* (2013.01); *F27D 3/08* (2013.01); *F27D 3/14* (2013.01); *F27D 2007/063* (2013.01)

(58) Field of Classification Search

CPC . H05B 7/00; H05B 7/152; H05B 3/03; B22D 23/10; C22B 9/18

See application file for complete search history.

(56) References Cited

U.S. PATENT DOCUMENTS 3,614,284 A * 10/1971 Scheidig ..... H05B 7/102 373/105
4,238,634 A 12/1980 Krogsrud
4,307,263 A * 12/1981 Rashev ..... H05B 3/60 373/52
4,775,981 A * 10/1988 Kohnert ..... G01G 19/00 373/70

(Continued)

FOREIGN PATENT DOCUMENTS

CN 206298628 7/2018
DE 2852404 A1 6/1979

(Continued)

OTHER PUBLICATIONS

Austrian Examination Report dated Aug. 16, 2018.
Great Britain Search Report dated Jun. 11, 2018.

*Primary Examiner* — Gregory A Wilson
(74) *Attorney, Agent, or Firm* — Hudak, Shunk & Farine Co. LPA

(57) ABSTRACT

Melting plant having a melting chamber which by way of a gas protection hood is separated from the environment, wherein the gas protection hood or another part of the melting chamber encasement has a lead through in which an electrode rod for moving an electrode to be melted is guided in a gas-tight manner by way of a sealing means. Hydraulic or pneumatic equalisation means, for exerting on the electrode rod equalisation forces which are in a proportional correlation with the gas pressure prevailing within the melting chamber are provided so as to compensate for the gas-pressure forces acting on the electrode rod.

8 Claims, 1 Drawing Sheet

(56) References Cited

U.S. PATENT DOCUMENTS

| | | | | |
|---|---|---|---|---|
| 5,533,043 | A | 7/1996 | Forestier | |
| 6,036,915 | A * | 3/2000 | Kuhne | B22D 41/00 266/158 |
| 6,973,116 | B2 * | 12/2005 | Popov | C22B 9/18 373/158 |
| 9,538,587 | B2 * | 1/2017 | Oehler | H05B 7/148 |

FOREIGN PATENT DOCUMENTS

| | | | |
|---|---|---|---|
| DE | 69401619 | T2 | 6/1997 |
| DE | 19729317 | A1 | 1/1999 |
| DE | 103 08 982 | B3 | 3/2004 |
| JP | S6294791 | A | 5/1987 |
| JP | 62-156526 | | 7/1987 |
| JP | 2001214868 | A | 8/2001 |

* cited by examiner

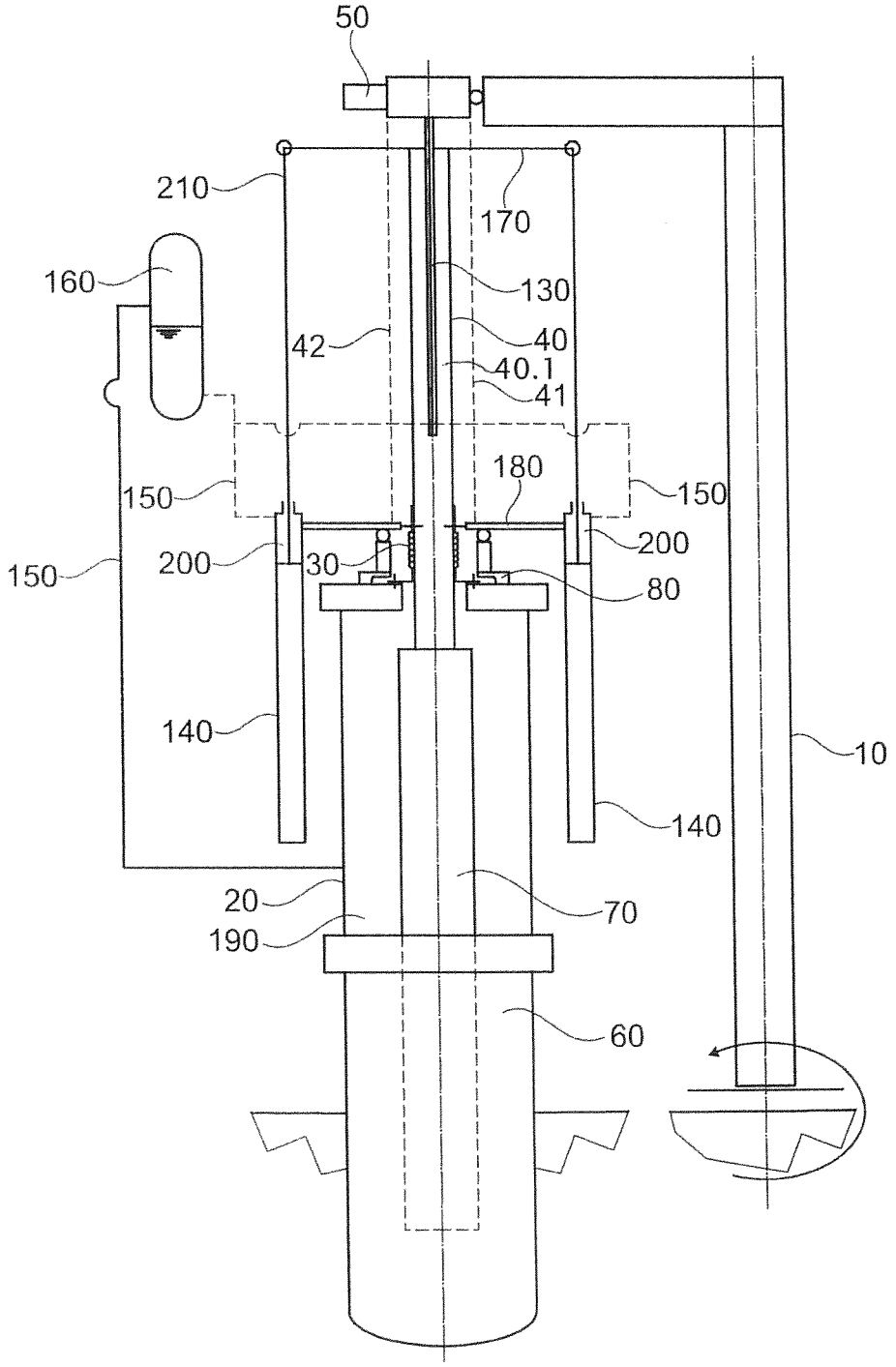
50
210
170
160
130
42
40
40.1
41
180
150
150
150
200
200
30
80
140
10
140
20
70
190
60

MELTING PLANT AND METHOD

FIELD OF INVENTION

The present invention relates to a re-melting plant for re-melting electrodes and to a corresponding method for operating an electrode re-melting plant.

BACKGROUND OF THE INVENTION

The melting plants or re-melting plants, respectively, which are known in practice comprise mainly a supporting construction having a frame, a framework, a gantry, or a pillar, and a gas protection hood in the form of a gas-tight cylinder, a lead through in the upper end of the gas protection hood, an electrode rod which by way of the lead through is introduced into the gas protection hood in a pressure-tight or vacuum-tight manner, and a drive unit which moves the electrode rod vertically upwards or downwards in the gas protection hood. One or two melting stations in which the re-melting process of the electrode suspended from the electrode rod takes place are provided. A weighing installation is used for regulating the process.

Re-melting plants which are conceived such that the re-melting process can take place at an elevated gas pressure in the hood as well as at a reduced pressure such as, in particular, a vacuum, are known in practice. It is specifically in the case of these re-melting plants in which the re-melting process is carried out at a gas pressure which differs from the atmospheric pressure that there is the problem that an additional force which in the case of positive pressure under the hood can be referred to as an ejection force and in the case of a vacuum under the hood can be referred to as an intake force acts on the electrode rod. In a manner corresponding to the concept of the plant and the concept of the electrode rod drive of the plant, said force acts on the drive elements of the electrode rod such that said drive elements are not only stressed by the weight of the electrode but additionally also by said intake or ejection force. This stress is particularly dangerous when the re-melting process is carried out at an elevated gas pressure and the vertical movement of the electrode rod is performed by way of a drive spindle which is disposed in a coaxial manner in the electrode rod. The risk of buckling is to be mentioned specifically. In the case of the known embodiments, a spindle with a very large diameter is used so that said spindle can resist the buckling that may be caused by a corresponding ejection force.

SUMMARY OF THE INVENTION

The invention is based on the object of achieving a re-melting plant in which the forces on the electrode rod and on the electrode rod drive are compensated for such that the electrode rod is not imparted any or only highly reduced additional forces, independently of the gas-pressure conditions prevailing under the hood of the plant. Moreover, the plant is to be designed in a robust and cost-effective manner.

This object is achieved by the features of the independent claims. Preferred refinements are the subject matter of the dependent claims.

A melting plant according to the invention comprises a melting chamber which by way of a gas protection hood is separated from the environment. The gas protection hood herein, or another part of the melting chamber encasement has a lead through in which an electrode rod for moving an electrode to be melted is guided in a gas-tight manner by way of the sealing means. Equalization means, in particular hydraulic or pneumatic equalization means, for exerting on the electrode rod forces which are in a proportional correlation with the gas pressure prevailing within the melting chamber are provided so as to at least partially compensate for the gas-pressure forces acting on the electrode rod. Since only forces which result from the weights of the electrode rod and of the electrode thus act on the drive unit, said drive unit can be conceived so as to be smaller. Regulating is also facilitated since there are no longer any influences of the internal pressure of the melting chamber on the electrode rod. Sealing means according to the invention are in particular seals such as annular seals, for example. Equalization cylinders in particular are to be considered as equalization means.

Equalization forces which in each case correspond to both positive pressure as well as to negative pressure in the melting chamber are advantageously capable of being exerted. This means that a first equalization force acts in an operation of the melting chamber at a positive pressure, and a second equalization force in the opposite direction acts in the operation at a negative pressure. The pressure in particular is a positive pressure or a negative pressure in relation to the ambient pressure. The ambient pressure can be the prevailing atmospheric pressure. To the extent that devices which are able to compensate for only a positive pressure in the melting chamber should already be available, the degree of freedom in the choice of operating states is significantly increased as compared to embodiments of such type.

It is furthermore advantageous for a drive unit for moving the electrode rod to be disposed above the electrode rod. This can also be in the upper end region of the electrode rod. This can also be designed in such a manner that the motor/drive and/or a respective gearbox of the drive unit in every operating state is located above that region that serves for sealing in relation to the gas protection hood. This is a significant advantage as compared to conventional embodiments in which the drive unit for moving the electrode rod has been fastened to the gas protection hood. In order for a coupling to the electrode rod to be enabled, the latter must be connected to a corresponding profile such as to a rack. However, this has complicated sealing of the melting chamber in the past.

The drive unit can in particular be connected to a drive spindle which engages with the electrode rod, and the drive spindle can furthermore be provided with an external thread and engage with a corresponding internal thread of the electrode rod. This is an example of a specific constructive embodiment of the mounting of the electrode rod. Alternatively, this could also be established by way of a hydraulic drive between a frame and the electrode rod. In the case of these embodiments, the cylindrical external face of the electrode rod can be free from drive structures such as, for example, a rack profile which would significantly complicate sealing. By contrast, if only a longitudinal groove has to be incorporated in the electrode rod in order for an anti-rotation protection of the electrode rod to be obtained, the sealing properties are not substantially reduced on account thereof.

It is furthermore advantageous for the drive unit by way of at least one guide to be connected to a lower traverse and for the lower traverse to be connected to stationary portions of the equalization means, in particular to the cylinders thereof, and for an upper traverse to be connected both to the electrode rod as well as to movable portions of the equalization means, in particular to the pistons thereof. The working direction of the equalization means is the vertical direction. The construction is imparted improved strength in relation to buckling specifically by the use of the guides which run from the overhead drive unit parallel with the electrode rod and with the drive spindle. The connection between the upper traverse and the electrode rod is a rotatable mounting. Joints are provided at the required locations in order to avoid over-determined statics. The drive spindle herein when viewed horizontally is located between the guides mentioned in every operating state. Guides which can be connected to piston rods of the equalization means or be part of the piston rods are in particular used as guides. The guide should not be elastic so as to be able to transmit the desired vertical equalization forces in both directions.

In the case of one further advantageous embodiment of the invention the drive unit for driving the electrode rod is coupled to a frame. Forces or torques which result from weights of the electrode rod and from a received electrode can be dissipated to the environment by way of the frame. The frame is advantageously embodied so as to be independent from the gas protection hood. It results on account thereof that the forces of the electrode rod and of the electrode do not have to be dissipated by way of the melting chamber encasement conjointly with the gas protection hood.

In particular, a plurality of equalization means, in particular equalization cylinders, can be disposed so as to be offset radially from the central axis of the electrode rod and herein so as to be preferably symmetrically disposed such that the generation of a tilting momentum or of a torque on the electrode rod is avoidable in the activation of the equalization means. At least 2 equalization cylinders are preferably employed here.

The equalization means can comprise a piston/cylinder arrangement, and the sum of the individual effective cross sections of the individual pistons of all of the equalization means is largely identical to the cross-section of the electrode rod. The term "largely identical" is to be interpreted in a wide sense and to include cross-sectional deviations of up to +/−30%. In the case of other preferred exemplary applications, it can be required that the deviations are to be less than 10%, on account of which it is achieved that the de-coupling of the pressure within the melting chamber from the output of a drive device for the piston rod is improved.

The equalization means in terms of fluid technology communicate with the melting chamber, for example by means of lines which run from the melting chamber to the equalization means. In particular, an oil container can communicate pneumatically with the melting chamber and be hydraulically connected to the equalization means. No oil is preferably used on the side of the melting chamber by virtue of the increase in temperature during melting. A hydraulic drive is preferred on the side of the equalization means since improved rigidity is thus enabled.

In the case of a method for operating an electrode melting plant and electrode by way of an electrode rod is movable in a melting chamber, and the melting chamber is sealed in a gas-tight manner in relation to the environment. A drive unit is disposed outside the melting chamber and drives the electrode rod. The resulting forces on the electrode rod both at a positive pressure as well as at a negative pressure in the melting chamber are equalized by at least one equalization means which in terms of fluid technology communicates with the melting chamber.

The melting plants of this invention are suitable for use in electroslag re-melting methods. The method according to the invention is preferably an electroslag re-melting method.

DESCRIPTION OF THE FIGURE

An advantageous embodiment of the plant is illustrated in the appended FIG. 1.

The construction shown in FIG. 1 comprises a frame 10, a gas protection hood 20 in the form of a gas-tight cylinder, a lead through 30 in the upper end of the gas protection hood 20, an electrode rod 40 which by way of the lead through 30 is introduced into the gas protection hood 20 in a pressure-tight or vacuum-tight manner, respectively, a drive unit 50 which can move the electrode rod 40 vertically upwards or downwards in the gas protection hood 20, a melting station 60 in which the re-melting process of the electrode 70 that is suspended from the electrode rod 40 takes place, and a weighing installation 80 which is provided for regulating the process.

The drive unit 50 is disposed directly above the electrode rod 40 and by way of the guides 41 and 42 is vertically connected to the weighing installation 80, wherein a drive spindle 130 is suspended inside the interior 40.1 of and coaxially to the electrode rod 40. The drive unit 50 is supported in an articulated manner laterally on the frame 10. The frame 10 is embodied so as to be pivotable and can transfer the entire system of the gas-tight gas protection hood 20 conjointly with the electrode rod 40, the drive unit 50, and the weighing installation 80, from the melting station 60 shown to a further melting station (not shown).

Two equalization cylinders 140 are disposed on either side of the electrode rod 40, the piston-rod chambers 200 of said equalization cylinders 140 by way of lines 150 and an oil container 160 being connected to the gas chamber 190 of the gas-tight hood 20. The gas chamber 190 hereunder is also referred to as the melting chamber 190.

The electrode rod 40 in an upper region as well as in a lower region and in each case by way of one traverse 170 and 180 is connected in an articulated manner to the equalization cylinders 140, wherein the piston rods 210 of said equalization cylinders 140 are connected in an articulated manner directly to the upper traverse 170 at the upper end of the electrode rod 40, and the equalization cylinders 140 are also connected in an articulated manner to the lower traverse 180 such that the lower traverse 180 comprises the upper end of the gas-tight lead through 30 and, on the other hand, is fastened in an articulated manner to a weighing frame of the weighing installation 80.

The functioning of the plant is described as follows. As soon as a pressure differential is created between the interior chamber of the vessel, that is to say the melting chamber 190, and the atmosphere, for example by way of an intake or a discharge of gas, said pressure differential by way of the gas lines 150 is transmitted into the oil tank 160. Oil from the oil tank flows into the equalization cylinders 140 and, on account of the sum of the piston-ring areas of the two equalization cylinders 140 being equal to the sealed cross-sectional area of the electrode rod 40, two mutually cancelling forces are created. Said two forces are the compressive force on the electrode rod 40 in the case of pressure in the vessel in the direction from the inside to the outside, that is to say from the bottom to the top, and the compressive force on the piston faces of the cylinders in the direction from the top to the bottom. An equalization force from the electrode rod 40 is transmitted by way of the two traverses 170 and 180 into the piston rods 210 of the cylinders 140, and the injection force of the electrode rod 40 is compensated for by the two laterally acting cylinder forces. On account thereof, the remainder of the plant construction remains unstressed by the forces that are created by the pressure differential.

The advantages of this arrangement are as follows:

All forces which are initiated by the pressure differential between the atmospheric pressure and the vessel interior are enclosed in the electrode rod system and do not have any effect on the remainder of the plant.

The drive spindle of the electrode rod can be conceived as is the case in a conventional plant which operates only under atmospheric conditions.

All melting regulators of the plant controller can remain unchanged in the case of application conditions at a variable melting-chamber pressure since the forces that are initiated by pressure do not act on the drive of the electrode rod and on account thereof, do not play any part in the output of the drive.

The system functions in an identical manner in both directions, i.e. at an internal pressure (positive pressure) the same as at a negative pressure (for example also a vacuum) in the melting chamber 190.

On account of the gas pressure not being induced directly into the equalization cylinders 140 but first into the oil tank 160 which is interdisposed between the melting chamber 190 and the equalization cylinders 140, said gas pressure is converted to an oil pressure. Since the friction conditions for the application in both cylinders are relatively similar, no additional synchronization or equalization of the friction forces existing therein is required.

The slag dust that is created in the plant is caught in the oil and is only disposed of by an oil change; there is no risk of the poisonous slag and metal dust being inadvertently dispersed into the environment.

The construction of the equalization system is simple and can be implemented without sizeable modification measures in almost all plants that have already been built.

The equalization cylinders 140 are aligned vertically such that the piston rods 210 thereof are offset radially from the electrode rod 40. The cylinders of the equalization cylinders overlap at least partially in the radial direction in relation to the electrode rod 40. Alternatively, to the two equalization cylinders 140 shown, a larger number of equalization cylinders of this type can be used, the latter preferably being distributed uniformly about the central axis of the electrode rod 40 so as to avoid unequal momentums on the electrode rod 40.

As has been described above and schematically illustrated in FIG. 1, the frame 10 is preferably rotatable about the vertical axis thereof. Proceeding from the frame 10, a further melting station (not shown) can be disposed so as to be opposite the melting station 60 shown. On account thereof, the restocking time for the plant after an electrode 70 has been melted down can be significantly reduced.

On account of the embodiment shown in which the drive spindle 130 is located within the electrode rod 40 it is possible for the (cylindrical) external surface of the electrode rod 40 to be designed so as to be largely flat and smooth. Since the sealing in relation to the gas protection hood 20 takes place on this face, the complexity in terms of sealing is reduced significantly, or the quantity of the gas that exits or enters, respectively, through the seal is significantly reduced. Tightness is important specifically in the operation of the plant at negative pressure since disadvantageous oxidation processes can otherwise arise on the melt.

LIST OF REFERENCE SIGNS

10 Frame
20 Gas protection hood
30 Lead through
40 Electrode rod
41, 42 Guides
50 Drive unit
60 Melting station
70 Electrode
80 Weighing installation
130 Drive spindle
140 Equalization means
150 Lines
160 Oil container
170 Upper traverse
180 Lower traverse
190 Melting chamber
200 Piston rod chamber
210 Piston

What is claimed is:

1. A melting plant having a melting chamber which by way of a gas protection hood is separated from the environment, wherein the gas protection hood has a lead through in which an electrode rod for moving an electrode to be melted is guided in a gas-tight manner by way of a sealing means, wherein hydraulic or pneumatic equalization means, for exerting on the electrode rod equalization forces which are in a proportional correlation with the gas pressure prevailing within the melting chamber are provided so as to compensate for the gas-pressure forces acting on the electrode rod, wherein a drive unit for moving the electrode rod is connected to the upper end of the electrode rod, wherein the drive unit comprising a drive spindle which engages with the electrode rod and wherein the drive spindle is provided with an external thread and engages with a corresponding internal thread of the electrode rod.

2. The melting plant according to claim 1, wherein the equalization means are specified such that compensation forces which correspond to a positive pressure as well as to a negative pressure in the melting chamber are capable of being exerted.

3. The melting plant according to claim 1, wherein the drive unit by way of at least one guide is connected to a lower traverse, and the lower traverse is connected to stationary cylinder portions of the equalization means, and an upper traverse is connected to both the electrode rod as well as to movable piston portions of the equalization means.

4. The melting plant according to claim 1, wherein the drive unit for driving the electrode rod is coupled to a frame and forces or momentums which result from weights of the electrode rod and from a received electrode are capable of being dissipated to the environment by way of the frame, the frame being embodied so as to be independent of the gas protection hood.

5. The melting plant according to claim 1, wherein a plurality of equalization means are disposed so as to be offset radially from the central axis of the electrode rod and so as to be symmetrically disposed such that the generation of the tilting momentum or of a torque on the electrode rod is avoidable in the activation of the equalization means.

6. The melting plant according to claim 1, wherein the equalization means have a piston/cylinder arrangement, and the sum of the effective cross sections of the individual pistons of the equalization means is largely identical to the cross-section of the electrode rod.

7. The melting plant according to claim 1, wherein an oil container communicates pneumatically with the melting chamber and is hydraulically connected to the equalization means.

8. A method for operating an electrode melting plant, in which an electrode rod moves an electrode in a melting chamber and the melting chamber is sealed in a gas-tight manner in relation to the environment, a drive unit is disposed outside the melting chamber and drives the electrode rod, the resulting forces on the electrode rod that result both at a positive pressure as well as negative pressure in the melting chamber being equalized by at least one equalization cylinder which in terms of fluid technology communicates with the melting chamber, wherein a drive unit for moving the electrode rod is connected to the upper end of the electrode rod, wherein the drive unit comprising a drive spindle which engages with the electrode rod and wherein the drive spindle is provided with an external thread and engages with a corresponding internal thread of the electrode rod.

* * * * *